US008121337B2

(12) United States Patent
Nedelcu

(10) Patent No.: US 8,121,337 B2
(45) Date of Patent: Feb. 21, 2012

(54) FREE AIR MAGNETIC CIRCUIT AND SPEAKER

(76) Inventor: Eugen Nedelcu, Meridian, ID (US)

( * ) Notice: Subject to any disclaimer, the term of this patent is extended or adjusted under 35 U.S.C. 154(b) by 770 days.

(21) Appl. No.: 12/206,520

(22) Filed: Sep. 8, 2008

(65) Prior Publication Data

US 2010/0060395 A1 Mar. 11, 2010

(51) Int. Cl.
*H04R 25/00* (2006.01)

(52) U.S. Cl. ..... 381/414; 381/412; 381/419

(58) Field of Classification Search ..... 381/396, 381/412, 414, 419, 430
See application file for complete search history.

(56) References Cited

U.S. PATENT DOCUMENTS

| | | | | |
|---|---|---|---|---|
| 2,295,527 | A | 9/1942 | Bowley | |
| 4,295,011 | A * | 10/1981 | Hathaway | 381/414 |
| 4,595,801 | A | 6/1986 | Coffin | |
| 5,664,024 | A * | 9/1997 | Furuta et al. | 381/412 |
| 6,088,466 | A * | 7/2000 | Proni | 381/397 |
| 6,587,570 | B1 | 7/2003 | Pavlovic | |
| 6,795,564 | B2 * | 9/2004 | Zhang | 381/420 |
| 6,940,992 | B2 | 9/2005 | Stiles | |
| 6,968,069 | B1 * | 11/2005 | Zhao | 381/345 |
| 7,065,225 | B2 | 6/2006 | Stiles | |
| 7,103,195 | B1 | 9/2006 | Kawata et al. | |
| 7,242,787 | B2 * | 7/2007 | D'Hoogh | 381/412 |
| 7,653,209 | B2 * | 1/2010 | Abe et al. | 381/414 |
| 2002/0090106 | A1 * | 7/2002 | Guenther | 381/412 |
| 2003/0099371 | A1 | 5/2003 | Ogura | |
| 2004/0101149 | A1 | 5/2004 | Furuyama | |
| 2005/0163338 | A1 | 7/2005 | Ohashi | |
| 2007/0053531 | A1 | 3/2007 | Ohta et al. | |

FOREIGN PATENT DOCUMENTS

| | | |
|---|---|---|
| EP | 0613322 A2 | 8/1994 |
| JP | 06-233384 | 8/1994 |

* cited by examiner

*Primary Examiner* — Suhan Ni
(74) *Attorney, Agent, or Firm* — TraskBritt

(57) ABSTRACT

Disclosed is a free air magnetic circuit and speaker in which no pole piece is used. A magnet layer is located between a top plate and a back plate with a gap defined essentially in the center thereof. Into the gap, a wire coil attached to a diaphragm may be inserted. A magnet flux passes between the top and back plates. In some embodiments, the interior edge of each of the metal plates tapers toward the gap, and the magnet layer extends past the peripheral edge of each of the metal plates so as to discourage magnetic flux between the metal layers at the peripheral edge.

20 Claims, 10 Drawing Sheets

FREE AIR MAGNETIC CIRCUIT AND SPEAKER

FIELD OF THE INVENTION

The invention generally relates to speaker systems, and more particularly to a magnetic circuit for a speaker system in which no pole piece is included.

BACKGROUND OF THE INVENTION

Speakers convert electrical signals to sound via the use of drivers. A conventional driver 10 for a speaker is shown in FIGS. 1, 2, and 13. Common drivers 10 include a basket or frame to which is attached a lightweight diaphragm 22. Attached to the diaphragm 22 is a wire coil 20 wound round a pole piece 12 that sits at the center of a magnet ring 14 sandwiched between a top plate 16 and a back plate 18.

The magnet ring 14 is usually polarized in the direction of the ring's thickness, e.g., with the north pole 80 adjacent the top plate 16 and the south pole 90 adjacent the back plate 18. As shown in FIG. 3, the magnet ring 14 generates a magnetic flux 30 that is dense in the gap 24 between the top of the pole piece 12 and the top plate 16. The wire coil 20 is located in this gap 24 between the pole piece 12 and the magnet layer 14 and metal plates 16, 18. An electrical signal is applied to the wire coil 20, which in turn makes the wire coil 20 an electromagnet and produces a magnetic field. The wire coil's magnetic field interacts with the magnet and metallic layers' field so as to generate a mechanical force that causes the wire coil 20 to move up or down, depending on the signal sent to the wire coil 20. The motion of the wire coil 20 causes the diaphragm 22 to move or vibrate, which vibration produces audible sounds.

The conventional driver 10 has its short comings. For example, conventional drivers 10 include a back surface that generally is integrated with the back plate 18 of the magnetic circuit. When the diaphragm 22 moves, the air and sound waves 70 formed behind the diaphragm 22 are trapped by the back surface 18, as shown in FIG. 13. This causes distortion of the sound and inhibits the free motion of the diaphragm 22. Further, speakers with conventional drivers 10 are generally thick, e.g., on the order of two to three inches. This makes these speakers less conducive to use in environments in which thinner speakers would be more desirable, such as when mounting speakers in walls or in automobiles.

Another large problem with conventional drivers 10 is the high level of inductance due to the use of the ferrous metal pole piece 12. Any wire coil 20 with a current will create inductance, and the placement of a larger metal pole piece 12 inside the coil 20 creates an even larger amount of inductance. In the speaker, the higher the level of inductance, the greater the distortion in the sound quality. At higher frequencies, inductance is even more a problem.

The use of the ferrous metal pole piece 12 also leads to distortions in the loudspeaker's transducer for other reasons. For example, using a pole piece 12 causes dynamic non-linearity in a moving coil transducer, such as that of the wire coil 20 when in operation. Additionally, movement of the wire coil 20 along the pole piece 12 causes eddy currents and flux modulation. The eddy currents produce heat, which alters the resistance of the wire coil 20. Accordingly, the inclusion of a ferrous metal pole piece 12 in the conventional driver 10 leads to much undesirable distortion in the produced sound.

SUMMARY OF THE INVENTION

Embodiments of the present free air magnetic circuit and speaker provide for a driver that does not require a pole piece and does not utilize a backing behind the diaphragm. Accordingly, the speaker may be thinner and has reduced amounts of acoustic and electrical distortion due to the essential elimination of sound reflections behind the diaphragm and the reduction of eddy currents, inductance, and heat production. Thus, the sound of the speaker is less distorted than the sound produced by the conventional speaker.

In particular, the free air magnetic circuit and speaker includes a magnet layer sandwiched between two metal layers, i.e., between a top plate and a back plate. A gap is located in the center of the layers such that each layer surrounds the gap. The gap is designed to receive the wire coil of the speaker in the same manner that a wire coil is placed in the gap of a conventional magnetic circuit for a speaker. However, the gap of the free air magnetic circuit does not include a pole piece nor is there a backing behind the diaphragm that is attached to the wire voice coil.

It is preferred that the top plate and bottom plate include tapering portions that taper toward the gap such that each later is thinner in thickness closest to the gap than they are at their peripheral edges. This concentrates the magnetic flux in a narrower area within the gap, allowing for increased efficiency. In other embodiments, however, the top and bottom plates do not include the tapering portions such that they are of consistent thickness both near the gap and at their peripheral edges.

Further, it is preferred that the magnet layer be wider and extend past both the top and back plates. This discourages flux leakage between the top and back plates at the peripheral edges of each. In other embodiments, however, the magnet layer is no wider than the top and back plates.

Still further, it is preferred that the each of the top plate, magnet layer, and back plate are ring shaped. However, in other embodiments, any or each of the three layers are otherwise shaped, as in a rectangle, triangle, rhombus, parallelogram, oval, star, pentagon, hexagon, octagon, or other polygon.

Moreover, it is preferred that a unitary, solid magnet layer be utilized between the top and back plates. However, in other embodiments, a segmented magnet layer are utilized. The magnet segments comprising the segmented magnet layer may be wedge shaped, or shaped in any other shape between the top and back plates. Additionally, any number of magnet segments may be utilized to comprise the segmented magnet layer.

In any embodiment, because the free air magnetic circuit does not include the pole piece in the gap, the level of inductance, eddy currents, heat production, and therefore sound distortion, is decreased or eliminated. Additionally, because there is no backing behind the diaphragm, sound waves are not trapped behind the diaphragm, which also decreases the amount of acoustic sound distortion in the speaker containing this free air magnetic circuit.

The purpose of the foregoing Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention.

As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
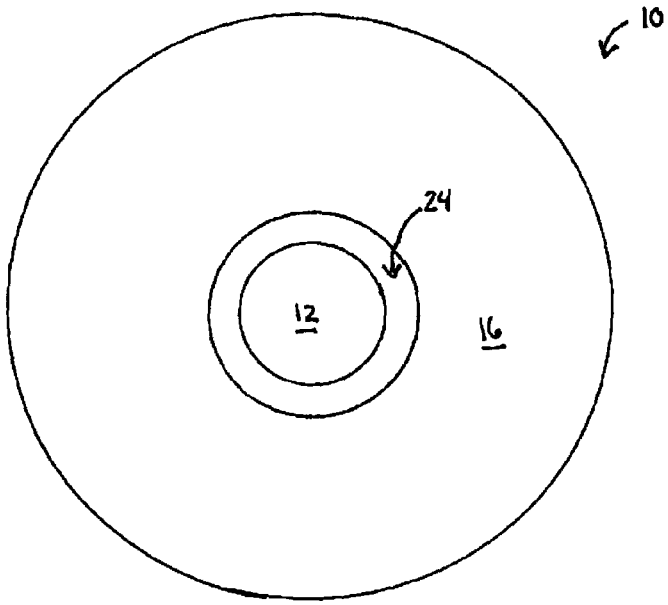
FIG. 1 (RELATED ART)
FIG. 1 is a top view of a conventional magnetic circuit for a conventional speaker without a wire coil in place in the gap.
Figure 2:
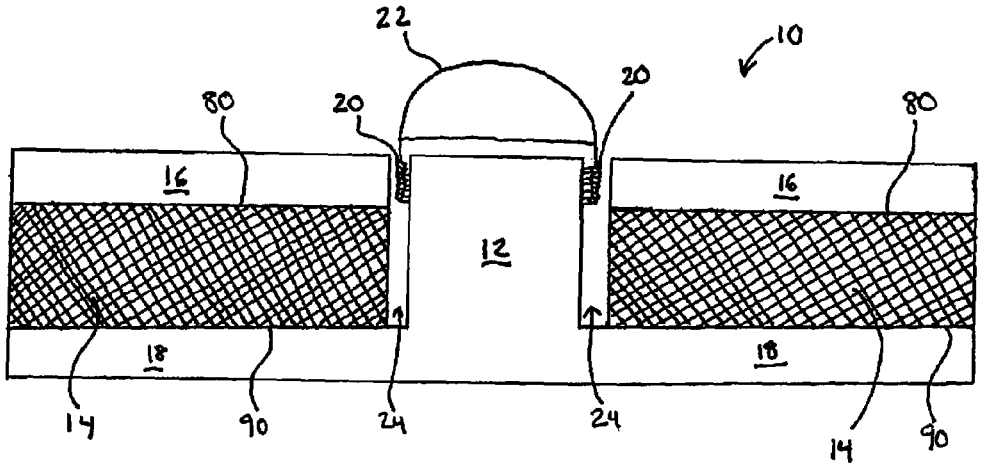
FIG. 2 (RELATED ART)
FIG. 2 is an elevation sectional view of a conventional magnetic circuit for a conventional speaker with a wire coil in place in the gap.
Figure 3:
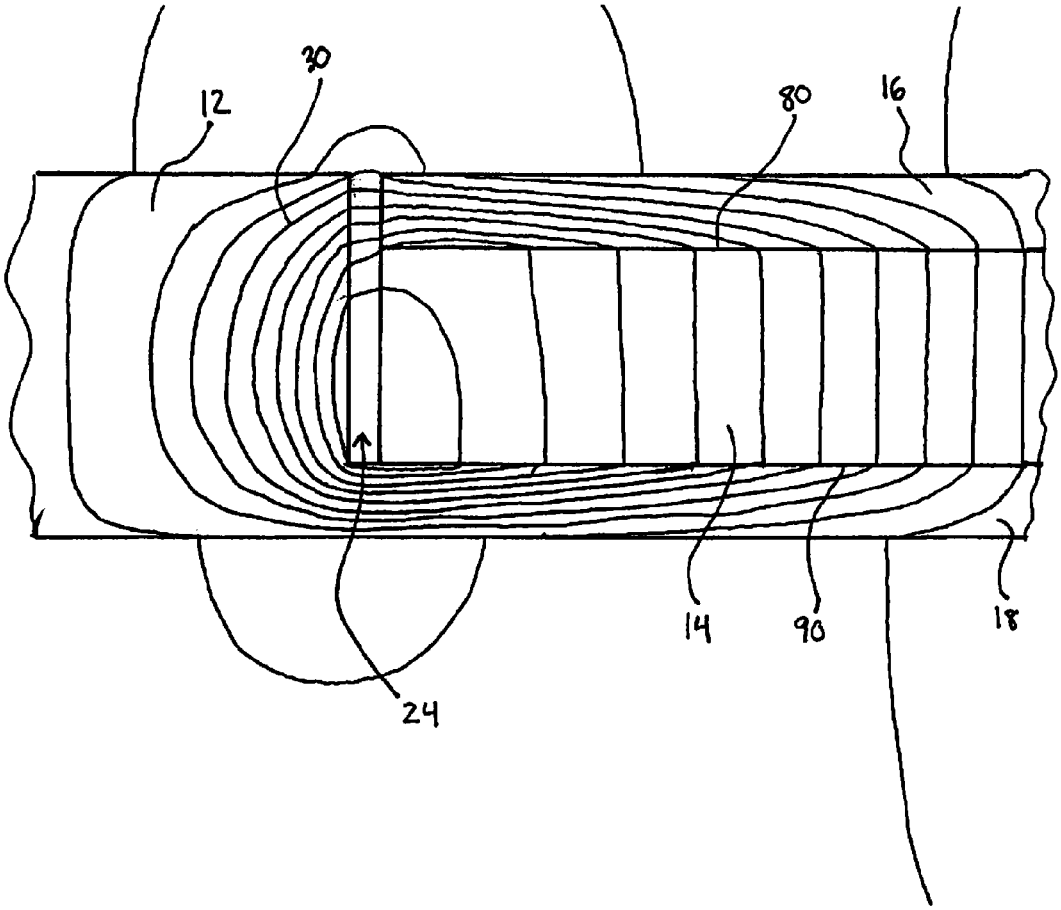
FIG. 3 (RELATED ART)
FIG. 3 is a magnetic flux distribution map of the conventional magnetic circuit shown in FIGS. 1 and 2.
Figure 4:
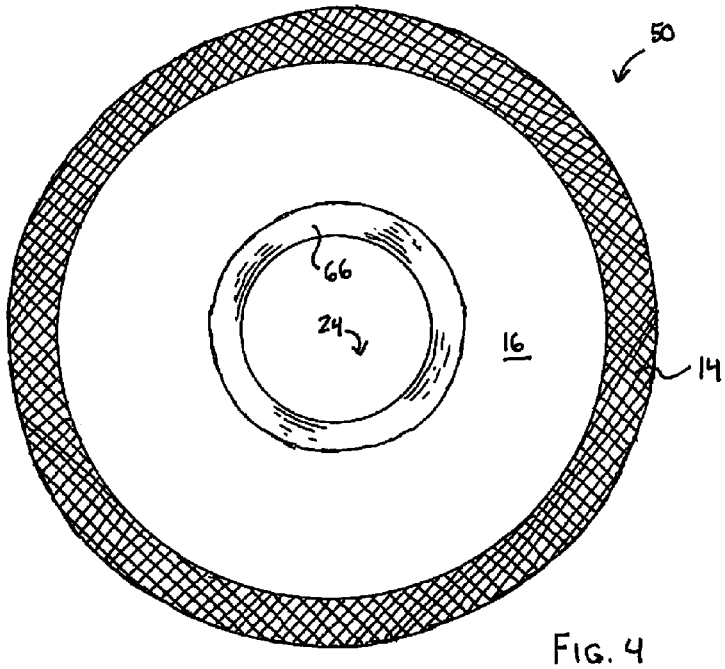
FIG. 4 is a top view of a free air magnetic circuit for a speaker according to a first embodiment.

While the free air magnetic circuit and speaker is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "or" indicates a non-exclusive alternative without limitation unless otherwise noted. The use of "including" means "including, but not limited to," unless otherwise noted.

FIGS. 4 through 8 depict a first embodiment of the free air magnetic circuit 50 for inclusion in a speaker. Like a conventional magnetic circuit 10, the free air magnetic circuit 50 includes a top plate 16, a back plate 18, and a magnet layer 14 in between. In some embodiments, the top plate 16, back plate 18, and magnet layer 14 are all in the form of a ring such that each layer 16, 18, 14 has a peripheral edge forming the outer circumference of each ring and an inner edge forming the inner circumference of each ring. Other embodiments utilize layers of different shapes.

Figure 13:
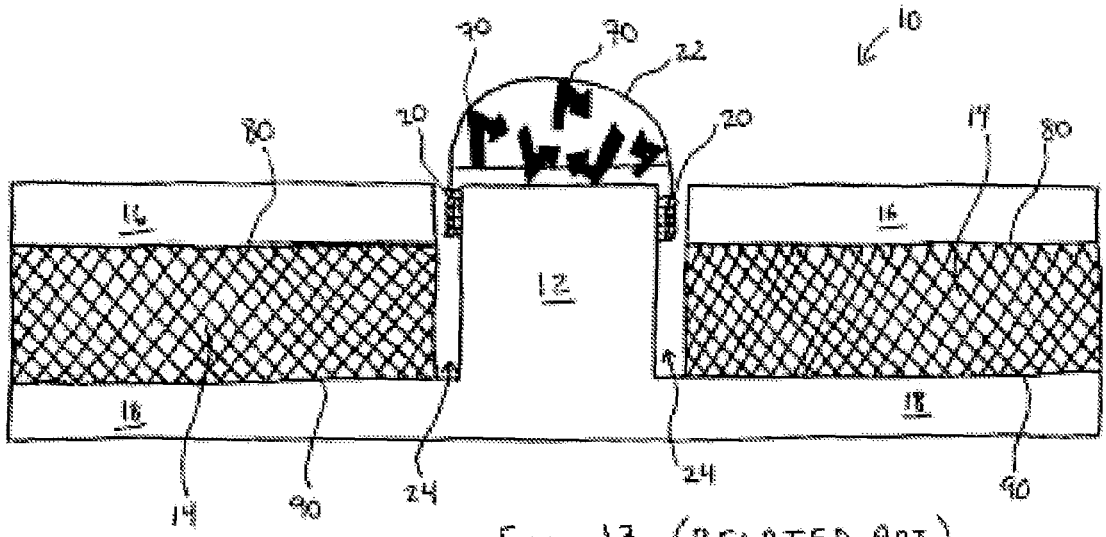
FIG. 13 (RELATED ART)
FIG. 13 is an elevation sectional view of a conventional magnetic circuit for a conventional speaker depicting the sound waves under the diaphragm.
Figure 14:
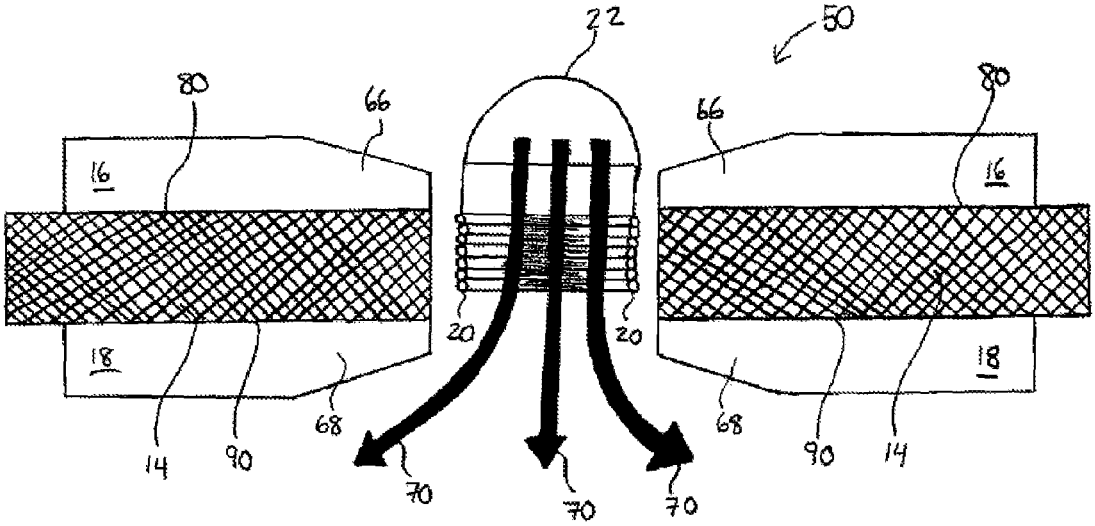
FIG. 14 is an elevation sectional view of a free air magnetic circuit for a speaker according to the first embodiment depicting the sound waves under the diaphragm.

According to the first embodiment, between the inner edges of each layer 16, 18, 14 is a gap 24. As with a conventional magnetic circuit 10, the gap 24 of the free air magnetic circuit 50 is configured to receive a wire coil 20 that is attached to a diaphragm 22. However, unlike a conventional magnetic circuit 10, the gap 24 of the free air magnetic circuit 50 does not contain a pole piece 12. Additionally, when the wire coil 20 is in place with its attached diaphragm 22, there is no back plate behind the diaphragm 22. The absence of the pole piece 12 reduces the level of inductance in the circuit 50, and the absence of the backing eliminates the back trapping of sound and air waves 70, as shown by FIG. 14 in comparison with FIG. 13, which in turn reduces sound distortion as compared to that experienced in the conventional magnetic circuit 10.

Figure 5A:
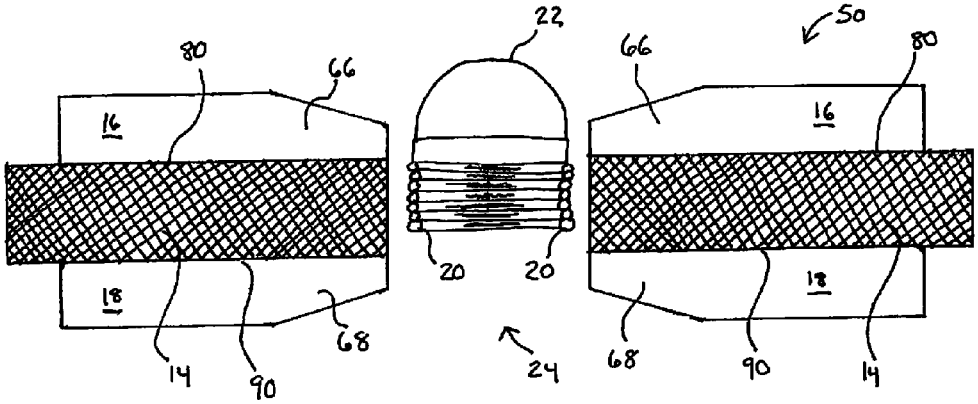
FIG. 5A is an elevation sectional view of a free air magnetic circuit for a speaker according to the first embodiment that depicts the use of a dome-shaped diaphragm.
Figure 5B:
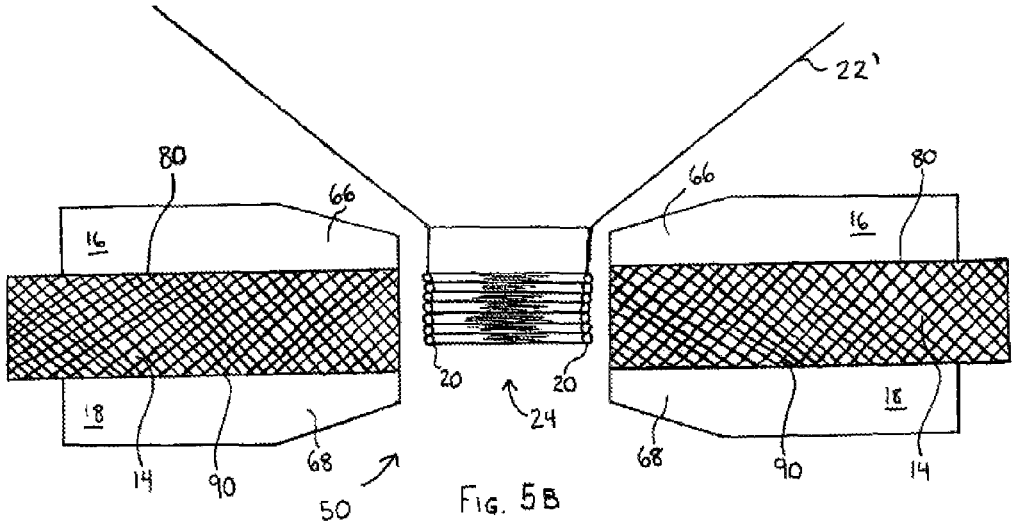
FIG. 5B is an elevation sectional view of a free air magnetic circuit for a speaker according to the first embodiment that depicts the use of a cone-shaped diaphragm.
Figure 5C:
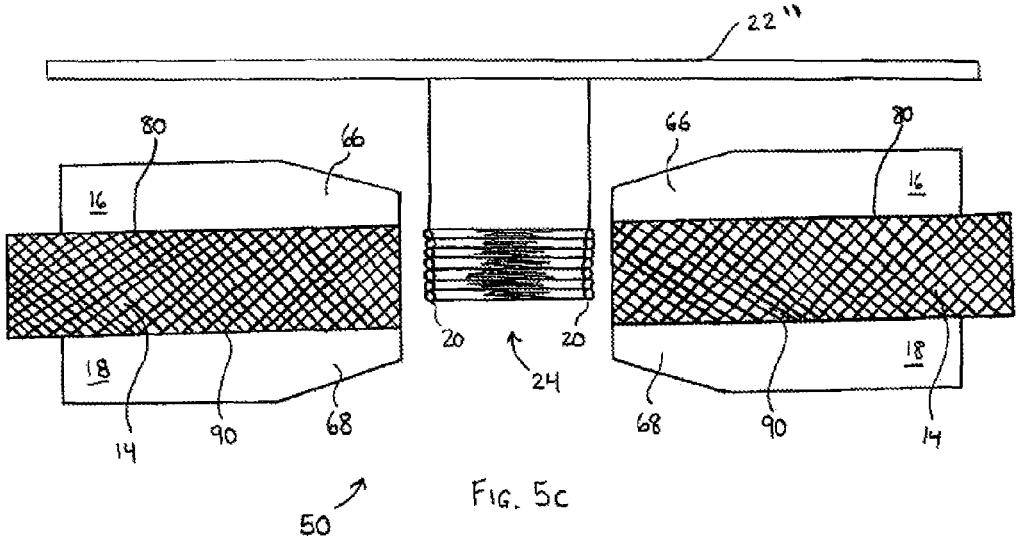
FIG. 5C is an elevation sectional view of a free air magnetic circuit for a speaker according to the first embodiment that depicts the use of a flat-shaped diaphragm.

As shown in FIGS. 5A, 5B, and 5C, according to the first embodiment, the top plate 16 includes a top tapering portion 66 near the top plate's interior edge while the back plate 18 includes a bottom tapering portion 68 near the back plate's interior edge. This focuses the magnetic flux into a narrower area in the gap 24. A magnetic circuit according to the first embodiment may be used with diaphragms of a number of shapes, including a dome-shaped diaphragm 22 (shown in FIG. 5A), a cone-shaped diaphragm 22' (shown in FIG. 5B), or a flat-shaped diaphragm 22" (shown in FIG. 5C).

According to the first embodiment shown in FIGS. 4 through 8 the magnet layer 14 is wider than the top plate 16 and the back plate 18 so that the magnet layer 14 sticks out past the top and back plates 16, 18. Accordingly, the magnet layer 14 is configured to discourage magnetic flux passing between the top plate 16 and the back plate 18.

Figure 6:
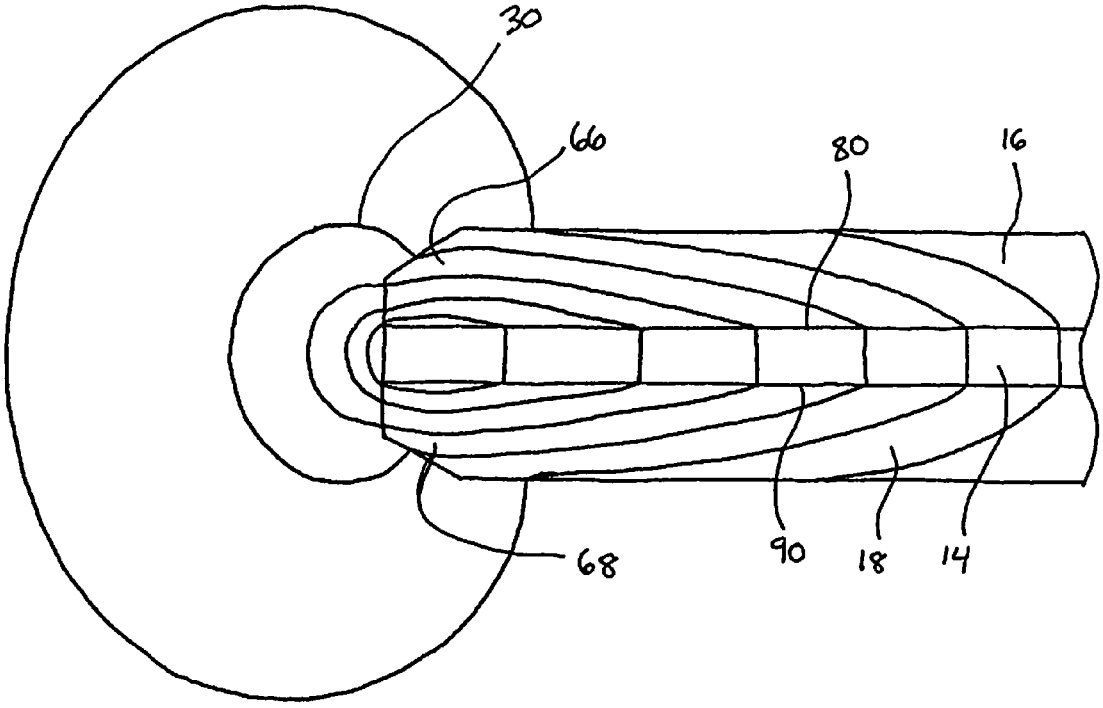
FIG. 6 is a magnetic flux distribution map of a free air magnetic circuit for a speaker according to the first embodiment.
Figure 8:
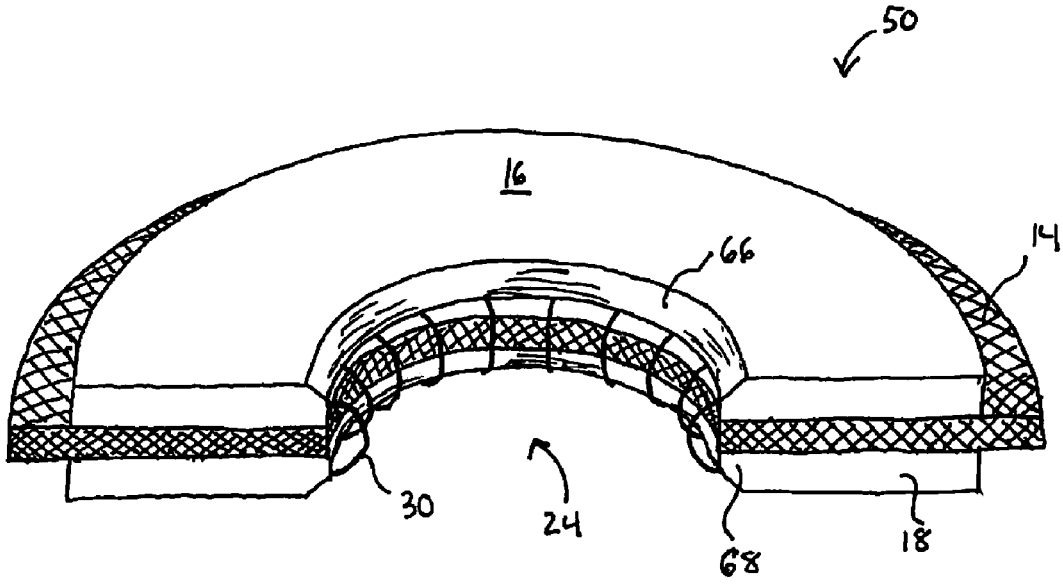
FIG. 8 is a side perspective view of a cross section of a free air magnetic circuit for a speaker according to the first embodiment.

It is also preferred that the magnet layer 14 of the free air magnetic circuit 50 be a strong magnet so as to maximize the magnetic flux 30 passing through the gap 24. This magnetic flux 30 is depicted in FIGS. 8 and 6. FIG. 6, in particular, maps an approximate distribution of the magnetic flux 30 of the free air magnetic circuit 50. As shown, the magnetic flux 30 is dense in the gap 24, particularly in an area near to the interior edge of each of the layers 16, 14, 18. It is in this area of dense magnetic flux 30 that the wire coil 20 is to be placed in the speaker.

Figure 7:
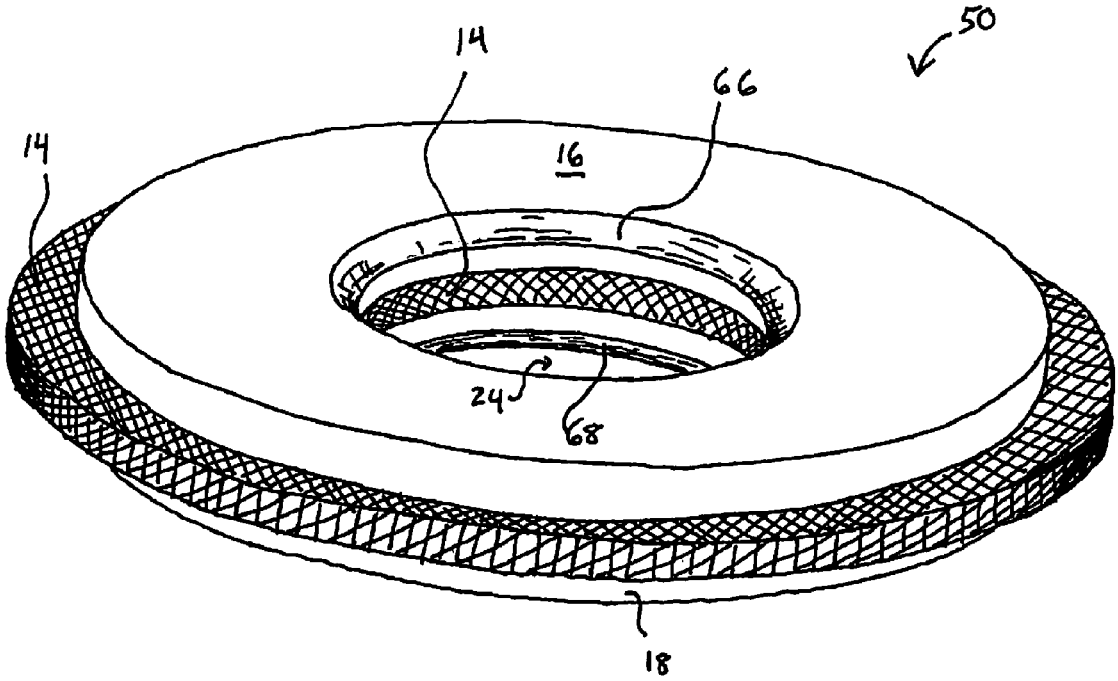
FIG. 7 is a side perspective view of a free air magnetic circuit for a speaker according to the first embodiment.

FIG. 7 and FIG. 8 show the first embodiment of the free air magnetic circuit 50 from a perspective view. Again, it is preferred that the interior edges of the top plate 16 and back plate 18 taper toward the gap 24.

According to the first embodiment, the magnet layer 14 be wider, i.e., configured so that, the circumference of its peripheral edge is greater than the circumference of the peripheral edge of both the top plate 16 and back plate 18.

It is preferred that the top plate 16 and back plate 18 be made of a ferrous-containing steel. However, any material that is affected by magnetic forces may be alternatively used.

Figure 9:
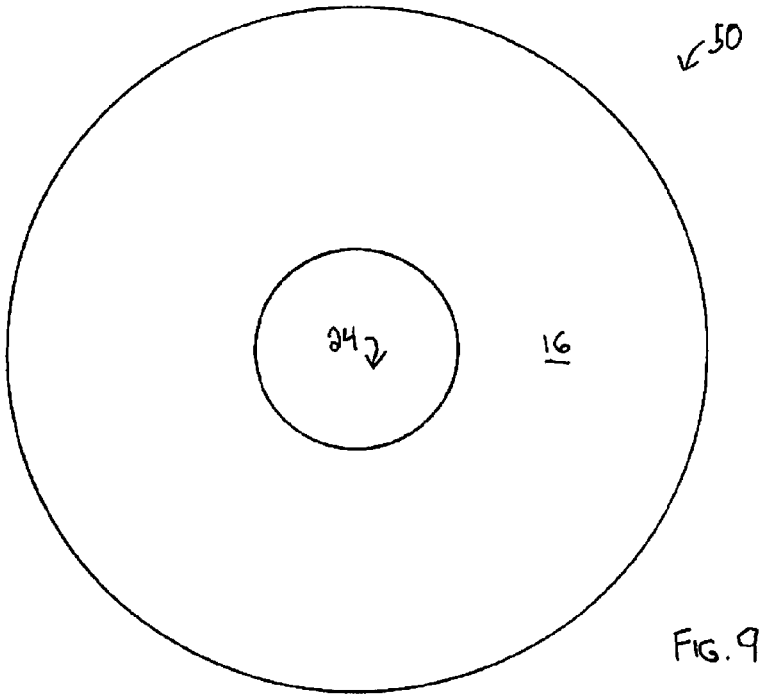
FIG. 9 is a top view of a free air magnetic circuit for a speaker according to a second embodiment.
Figure 10:
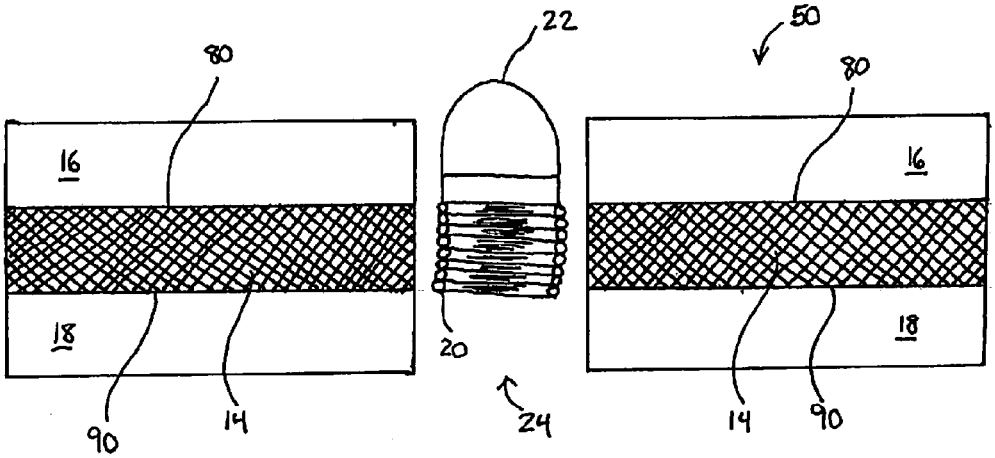
FIG. 10 is an elevation sectional view of a free air magnetic circuit for a speaker according to the second embodiment with a wire coil in place in the gap.

A second embodiment of the free air magnetic circuit 50 is shown in FIGS. 9 and 10. According to the second embodiment, the top plate 16 and back plate 18 do not contain tapering portions near in proximity of the gap 24. In addition, the magnet layer 14 is not wider than either the top plate 16 or the back plate 18. That is, the circumference of the peripheral edge of the magnet layer 14 is equal to the circumference of the peripheral edge of the top plate 16 and to the circumference of the peripheral edge of the back plate 18.

Figure 11:
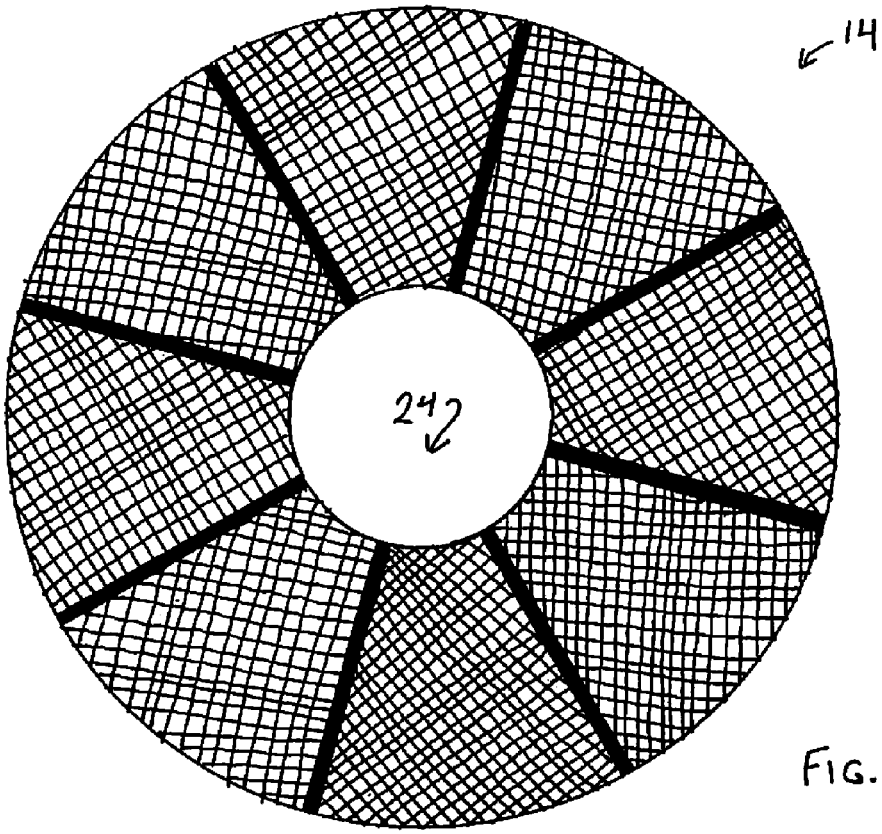
FIG. 11 is a top view of the magnet layer of a free air magnetic circuit for a speaker according to a third embodiment.

The magnet layer 14 of a free air magnetic circuit 50 according to a third embodiment is shown in FIG. 11. According to the third embodiment, the magnet layer 14 is segmented, such that the magnet layer 14 is not of one solid, unitary layer as it is according to the first embodiment. As shown in FIG. 11, in some embodiments, the magnet layer 14 can be segmented into angular slices. In other embodiments, the magnet layer 14 may be segmented into other shapes.

Figure 12:
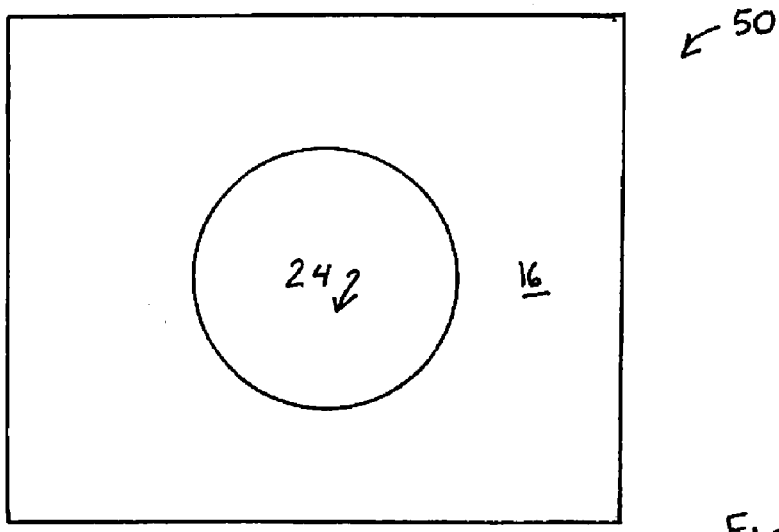
FIG. 12 is a top view of a free air magnetic circuit for a speaker according to a fourth embodiment.

A free air magnetic circuit 50 according to a fourth embodiment is shown in FIG. 12. According to the fourth embodiment, the top plate 16, magnet layer 14, and back plate 18 are each rectangular, rather than ring shaped. (While FIG. 12 is a top view of the free air magnetic circuit 50 according to the fourth embodiment, the bottom view of the free air magnetic circuit 50 according to the fourth embodiment would look essentially the same in shape.) In other embodiments, the layers 16, 14, 18, of the free air magnetic circuit 50 may be alternately shaped.

While there is shown and described the present preferred embodiment of the free air magnetic circuit for a speaker, it is to be distinctly understood that this invention is not limited thereto but may be variously embodied to practice within the scope of the following claims. For example, while the figures depict the magnet layer 14 being polarized so that the north pole 80 is adjacent the top plate 16 and so that the south pole 90 is adjacent the back plate 18, the magnet layer 14 may be oppositely polarized. As another example, while the free air magnetic circuit 50 is configured so that the wire coil 20 is to be placed within the gap 24 that is essentially central to the top plate 16, back plate 18, and magnet layer 14, the coil 20 may be alternatively configured to be placed externally to the peripheral edge of each of the layers 16, 14, 18 so that a gap 24 need not be defined internally to the layers 16, 14, 18. Additionally, the top plate and bottom plate may include tapering portions proximate to the peripheral edge of each; the top plate, magnet layer, and bottom plate may be shaped differently, as in a triangle, parallelogram, pentagon, hexagon, or other polygon; the top plate and bottom plate may be wider than the magnet layer such that the circumference of the peripheral edge of each of the top plate and back plate is greater than the circumference of the peripheral edge of the magnet layer; the magnet layer may be segmented in any number of segments and in any shape of segments; the top or back plate or both may be segmented in any number of segments and in any shape of segments; the magnet layer may be comprised of any number of stacked magnet layers; and/or either or both of the top plate and back plate may be comprised of any number of stacked metal plates. In any regard, from the foregoing description, it will be apparent that various changes may be made without departing from the spirit and scope of the invention as defined by the following claims.

What is claimed is:

1. A magnetic circuit comprising:

a top plate;

a back plate; and a magnet layer located between the top plate and the back plate;

the top plate, the back plate, and the magnet layer defining a gap adjacent to the top plate, the back plate, and the magnet layer;

a wire coil situated in the gap, the wire coil formed of windings defining a central axis around which the windings are wound, the windings also defining a first side facing the central axis and a second side facing away from the central axis;

the magnetic circuit configured to generate a magnetic flux flowing between the top plate and the back plate; and one of the first side and the second side of the windings of the wire coil not directly facing any magnetic material through which the magnetic flux is flowable when generated.

2. The magnetic circuit of claim 1, wherein the top plate comprises a top tapering portion, the top tapering portion bordering the gap; and the back plate comprises a bottom tapering portion, the bottom tapering portion bordering the gap.

3. The magnetic circuit of claim 1, wherein the magnet layer is wider than both the top plate and the back plate.

4. The magnetic circuit of claim 3, wherein the magnet layer is further configured to discourage a second magnetic flux from flowing between a peripheral edge of the top plate and a peripheral edge of the back plate.

5. The magnetic circuit of claim 1, wherein the top plate comprises a top plate interior edge that borders the gap;

the back plate comprises a back plate interior edge that borders the gap;

the magnet layer comprises a magnet layer interior edge that borders the gap; and wherein the top plate interior edge, the back plate interior edge, and the magnet layer interior edge align with one another.

6. The magnetic circuit of claim 1, wherein the top plate comprises a top tapering portion located in proximity to the top plate interior edge; and the back plate comprises a bottom tapering portion located in proximity to the back plate interior edge.

7. The magnetic circuit of claim 1, wherein the magnet layer is segmented.

8. The magnetic circuit of claim 1, wherein the top plate is ring shaped;

the back plate is ring shaped; and the magnet layer is ring shaped.

9. The magnetic circuit of claim 1, wherein the top plate is rectangular; and the back plate is rectangular.

10. The magnetic circuit of claim 1, wherein the magnetic circuit is configured to generate the magnetic flux flowing between the top plate and the back plate, passing through the gap such that the magnetic flux defines a magnetic path arcing more than ninety degrees through the gap.

11. A magnetic circuit comprising:

a top plate having a top plate interior edge and a top plate peripheral edge;

a back plate having a back plate interior edge and a back plate peripheral edge; and a magnet layer having a magnet layer interior edge and a magnet layer peripheral edge; the magnet layer being located between the top plate and the back plate;

the top plate interior edge, the back plate interior edge, and the magnet layer interior edge defining a gap;

a wire coil situated within the gap, the wire coil formed of windings defining an interior coil space and an exterior coil space, the interior coil space being substantially free of magnetic material;

the magnetic circuit configured to generate a magnetic flux flowing between the top plate and the back plate, passing through the gap and passing through magnetic material only in the exterior coil space.

12. The magnetic circuit of claim 11, wherein the top plate further comprises a top tapering portion located in proximity to the top interior edge;

the back plate further comprising a bottom tapering portion located in proximity to the bottom interior edge;

the magnet layer being wider than both of the top plate and the back plate such that the magnet layer's peripheral edge extends beyond the back plate peripheral edge and the top plate peripheral edge.

13. The magnetic circuit of claim 11, wherein the magnetic circuit is configured to generate a magnetic flux arcing more than ninety degrees while passing through the gap.

14. A speaker comprising:

a magnetic circuit comprising:

a top plate comprising a top plate interior edge;

a back plate comprising a back plate interior edge;

a magnet layer located between the top plate and the back plate, the magnet layer comprising a magnet layer interior edge;

the top plate, the back plate, and the magnet layer defining a gap essentially central to the top plate, the back plate, and the magnet layer and bordering the top plate interior edge, the back plate interior edge, and the magnet layer interior edge; the gap configured to receive therein a wire coil; and wherein the top plate interior edge, the back plate interior edge, and the magnet layer interior edge align with one another.

15. The speaker of claim 14, not comprising a magnetic body centrally situated within the gap.

16. The speaker of claim 14, wherein the top plate comprises a top tapering portion, the top tapering portion bordering the gap; and the back plate comprises a bottom tapering portion, the bottom tapering portion bordering the gap.

17. The speaker of claim 14, wherein the magnet layer is wider than both the top plate and the back plate.

18. The speaker of claim 17, wherein the magnet layer is further configured to discourage magnetic flux from flowing between a peripheral edge of the top plate and a peripheral edge of the back plate.

19. The speaker of claim 18, wherein the top plate is ring shaped;

the back plate is ring shaped; and the magnet layer is ring shaped.

20. The speaker of claim 14, wherein the top plate comprises a top tapering portion located in proximity to the top plate interior edge; and the back plate comprises a bottom tapering portion located in proximity to the back plate interior edge.

* * * * *